US008677704B2

(12) United States Patent
Trindade de Sousa Monteiro

(10) Patent No.: US 8,677,704 B2
(45) Date of Patent: Mar. 25, 2014

(54) MODULAR WALL SYSTEM

(76) Inventor: Luciano Trindade de Sousa Monteiro, Sao Caetano do Sul (BR)

( * ) Notice: Subject to any disclaimer, the term of this patent is extended or adjusted under 35 U.S.C. 154(b) by 339 days.

(21) Appl. No.: 12/579,915

(22) Filed: Oct. 15, 2009

(65) Prior Publication Data

US 2010/0095614 A1 Apr. 22, 2010

(30) Foreign Application Priority Data

Oct. 16, 2008 (BR) ..... 0804385

(51) Int. Cl.

| | |
|---|---|
| ***E04C 2/52*** | (2006.01) |
| ***E04H 1/00*** | (2006.01) |
| ***E04B 1/00*** | (2006.01) |
| ***E04F 19/00*** | (2006.01) |
| ***A47G 5/00*** | (2006.01) |
| ***A47B 81/00*** | (2006.01) |
| ***A47B 77/00*** | (2006.01) |
| ***A47F 3/00*** | (2006.01) |
| ***B42F 17/00*** | (2006.01) |

(52) U.S. Cl.

USPC ..... 52/220.7; 52/220.8; 52/238.1; 52/239; 52/270; 52/36.4; 160/135; 312/283; 312/286; 312/287; 312/107; 312/117; 211/10

(58) Field of Classification Search

USPC ..... 52/220.1, 220.7, 220.8, 238.1, 239, 52/270, 282.2, 36.4; 160/135; 108/193; 312/283–289, 107, 117, 351; 211/10, 211/189

See application file for complete search history.

(56) References Cited

U.S. PATENT DOCUMENTS

| | | | | | |
|---|---|---|---|---|---|
| 2,506,844 | A | * | 5/1950 | Smith | 312/107 |
| 3,257,154 | A | * | 6/1966 | Lewis | 312/198 |
| 3,655,065 | A | * | 4/1972 | Yellin | 211/194 |
| 3,677,202 | A | * | 7/1972 | Young | 108/109 |
| 3,834,776 | A | * | 9/1974 | Becker, Jr. | 312/108 |
| 3,856,147 | A | * | 12/1974 | Piretti | 211/188 |
| 3,961,586 | A | * | 6/1976 | Bernard | 108/60 |
| 3,999,818 | A | * | 12/1976 | Schankler | 312/111 |
| 4,162,113 | A | * | 7/1979 | Pallavicini | 312/199 |
| 4,192,562 | A | * | 3/1980 | Bishoff et al. | 312/108 |
| 5,310,071 | A | * | 5/1994 | Rivlin et al. | 220/23.4 |
| 5,595,127 | A | * | 1/1997 | Eustace et al. | 108/109 |
| D382,142 | S | * | 8/1997 | Kelly et al. | D6/479 |
| 5,775,046 | A | * | 7/1998 | Fanger et al. | 52/590.1 |
| 6,161,347 | A | * | 12/2000 | Yu et al. | 52/220.7 |
| 6,216,397 | B1 | * | 4/2001 | Chang | 52/36.1 |
| 6,457,595 | B1 | * | 10/2002 | Pritchard et al. | 211/189 |
| 6,481,168 | B1 | * | 11/2002 | Hodges et al. | 52/220.7 |
| 6,557,310 | B2 | * | 5/2003 | Marshall et al. | 52/220.1 |

(Continued)

*Primary Examiner* — Brain Glessner
*Assistant Examiner* — Omar Hijaz
(74) *Attorney, Agent, or Firm* — Reising Ethington P.C.

(57) ABSTRACT

Designed for office interior environments and layouts, there is provided a module wall system that comprises a module having a number of cavities and opposite cavities. The modules may include board plates, lateral plates, cover plates, and internal rails that are built to accommodate cables and utilities. The internal rails may be posted throughout the length of such modules and may interconnect with columns. The cavities may have cover plates positioned conveniently to form a structural, functional and decorative composition. The modules are interconnected, structured and fixed with the columns, which can be posted vertically and sitting on feet, to provide better stability. The columns are hollow and fitted with removable column cover for access to wiring or complementary accommodation of decorative objects. Modules may form various convenient work areas or cubicle layouts with functional and aesthetic environments. The columns may have different cross sectional formats, such as the square, triangular, hexagonal, etc. formats shown.

22 Claims, 3 Drawing Sheets

(56) References Cited

U.S. PATENT DOCUMENTS

| | | | | |
|---|---|---|---|---|
| 7,028,620 | B1 * | 4/2006 | Lyndon | 108/190 |
| 7,546,706 | B2 * | 6/2009 | Kirkwood | 52/69 |
| D602,709 | S * | 10/2009 | Williams et al. | D6/396 |
| 7,621,421 | B2 * | 11/2009 | Ohayon | 220/529 |
| D665,198 | S * | 8/2012 | Levy et al. | D6/478 |
| 2003/0196392 | A1 * | 10/2003 | Edwards | 52/220.1 |
| 2007/0062128 | A1 * | 3/2007 | Kirkwood | 52/79.1 |
| 2008/0185356 | A1 * | 8/2008 | Orbeck Aase | 211/153 |

* cited by examiner

MODULAR WALL SYSTEM

REFERENCE TO RELATED APPLICATIONS

This application claims priority from Brazilian Patent Application No. PI-0804385-0 filed Oct. 16, 2008, the entire contents of which are hereby incorporated by reference into this application.

TECHNICAL FIELD

The present invention generally relates to a modular wall system and, more particularly, to a modular wall system that integrates a wall with one or more shelves.

BACKGROUND

Modular wall system systems are currently used in a variety of different applications, including offices and reception areas. Some conventional modular wall system systems use one or more wall sections to delimit or partition different work areas or cubicles, however, a wall section by itself provides no means for storing or displaying objects like pictures, books, plants, etc. Thus, separate shelves, ledges, tables, etc. are required in addition to the wall section such that the overall area or footprint of the layout is increased. Furthermore, conventional wall sections can be somewhat unstable if they are not provided with additional securing means, such as the type that fastens the wall sections to the floor and/or ceiling.

Therefore, there is room for improvement in the area of modular wall systems; particularly, in the areas of saving space, increasing stability, easing the assembly and disassembly processes, and/or improving the economic and aesthetic characteristics of the system.

SUMMARY

According to one embodiment, there is provided a modular wall system, comprising a module and a column. The module may include one or more board plates, lateral plates, cover plates, and internal rails, wherein the board plates, the lateral plates, and the cover plates form cavities in the form of shelves or stylized boxes, and the internal rails provide for cable or utilities distribution. The column may be connected to the module and include one or more access holes that communicate with the internal rails such that the cables or utilities can extend from one module to another.

According to another embodiment, there is provided a module for use in a modular wall system. The module may comprise: flat horizontal members; flat vertical members attached to the flat horizontal members such that they form a criss-cross framework that includes a front side, a rear side, and cubby-holes located therebetween; cover plates attached to the framework such that they close off one or more sides of the cubby-holes; and an internal rail that is attached to the framework and extends through the module such that it accommodates one or more utilities. Wherein the module is both a partition and an integrated shelving system Although the following characteristics are not necessary for every embodiment of the modular wall system described herein, some potential advantages and/or characteristics that may be enjoyed include: a) better use of floor area than traditional cubical partitions that are known to use walls to delimit the bays or work areas and to supplement the walls with shelves that attached to tables, etc.; this can result in a larger area or footprint than that of the modular wall system described herein, which cuts down on its footprint by integrating a wall and a shelf into a single module; b) more structural integrity due to the integrated nature of the modular wall system which has a greater width than some traditional divisions; c) increased strength and durability due to the greater width of the modular wall system; d) improved stability and reduced accidents since many traditional cubicle divisions utilize small feet or base components that can be tipped over more easily; e) easy assembly, disassembly, and layout options due to the fact that the walls are modular and have enough structural stability so that they can be relocated by a user, without requiring specialized labor; f) more economical when compared to traditional cubicles that may require the purchase of both walls and additional shelves; g) more aesthetically pleasing since they have an infinite number of arrangement options, including the number of cavities, the depth of cavities, the arrangement of cavities, etc. which may result in a number of compositions and custom arrangements; and h) better functionality, as the modular wall systems are already equipped with internal rails for receiving all of the necessary wiring for the installation of computers, telephones, electricity, etc.

The modular wall system described herein may solve potential deficiencies inherent in certain conventional cubical walls that need separate stabilizer means, like feet members that extend beyond the footprint of the cubicle wall or those cubical walls that need to be bolted or otherwise fixed to the floor and/or ceiling. This may ultimately prejudice the lay-out flexibility of the system. Each of the modules described herein is optionally capable of staying upright with good stability by itself and may not require any additional stabilizer means. That is not to say, however, that additional stabilizer means couldn't be used; only that such means are not required.

The modules can be arranged and assembled to follow a layout that best meets the needs and functions of the particular application, with the columns used at intersections of two or more modules such that they make a panel wall junction, but also address the issue of cable and utilities distribution.

The modules, by the fact that they have a sufficiently rigid structure, may be positioned alone without any columns. In such an arrangement, the modules may be utilized as a stand-alone divider or as a book shelf, for instance, and can accommodate decorative elements to have a better visual composition.

Some examples of columns that have a suitable configuration and arrangement for being at the intersection of two or more modules include square, triangular, hexagonal, octagonal, etc.

Therefore, due to its innovative features, unique application, as well as its visual effect, the modular wall system described herein may be used as an integrated element in modern offices, reception areas, etc.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
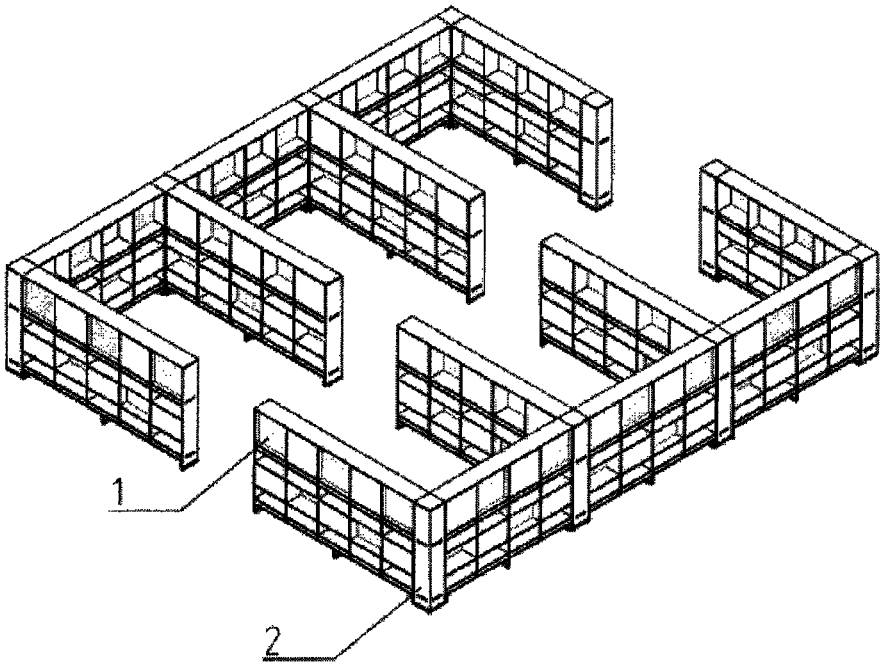
FIG. 1 is a perspective view of an exemplary layout of a modular wall system, illustrating a potential disposition within an office environment.
Figure 2:
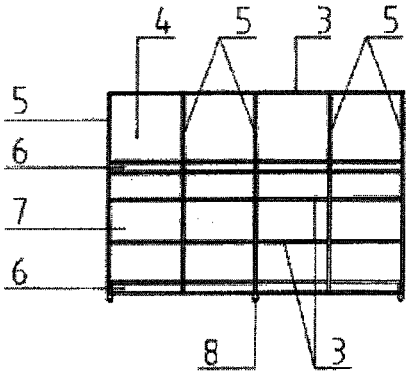
FIG. 2 is a front view of an exemplary modular wall system and illustrates some of its constructive features in the cavities arranged side-by-side and in the internal rails.

The modular wall system described herein is basically composed of modules 1 that, when properly mounted and interconnected, can form office cubicles, office work areas, bookshelves, etc. The components of the modular wall system may be built with any suitable material, including wood, wood-based substitutes, plastic, fabric, or any other desired material, and may be designed to receive nails, screws and/or any other type of attachment means to permit layout or aesthetic changes when desirable. According to one embodiment, a modular wall system integrates a wall and one or more shelves into a single module and includes one or more of the following components: a module 1, a column 2, a board plate 3, a cavity 4, a lateral plate 5, an internal rail 6, a cover plate 7, and a foot 8. The modular wall system may be designed to accommodate the necessary cables and utilities for computers, telephony, electrical connections, etc.

Each module 1 may include a plurality of board plates 3, lateral plates 5, and cover plates 7 that form adjacent cavities 4 in the form of shelves or stylized boxes or cubby-holes, where a first cavity 4 opens up to one side of the module and a second adjacent or opposed cavity 4A opens up to an opposite side of the module. This alternating or opposing cavity arrangement is illustrated best in FIGS. 1 and 6, and may provide at least two functions: one structural and another functional. Certain structural advantages may be obtained through use of the alternating cavity arrangement where the lateral plates 5 and cover plates 7 form a serpentine or undulating structural configuration (this is best seen in the top view of FIG. 6). For instance, module 1 may inherently be more stable and stronger due to the wide and sturdy foundation formed by the alternating structural members. In addition, certain functional advantages may be enjoyed by the alternating cavity arrangement shown herein, such as the alternating cavities serving as convenient shelves for placing, for example, small objects, pictures, books, etc. commonly displayed in offices. The alternating cavity arrangement thus provides mini-shelves on both sides of the modular wall system; a feature that can be particular useful if the modular wall system is to act as a partition or wall between two separate offices or cubicles. Of course, it is also possible for the module 1 to include cavities or cubby-holes that all open up on one side; preferably an inner side of a cubicle.

Cavities 4 and 4A may be sealed off on one end with a cover plate 7, which can be mounted at the back of the cavity to enclose the space, can be mounted near the center of the cavity (see FIG. 5 and the cavity located at the far right end of FIG. 6) in order to provide shelving on both sides of the modular wall system, or can be omitted altogether. Thus, the cover plates 7 can be aesthetically or functionally positioned at different and appropriate depths in the cavities 4, 4A. It is possible for cover plate 7 to be a solid and non-transparent cover, to be a semi-transparent cover such that light can penetrate but images are not clearly made out (e.g., glass block type of material), or to be a transparent cover like a window. Other types of cover plates and cover plate materials may be used as well. In order to improve the stability of the modular wall system, each of the modules 1 may be equipped with one or more feet 8 which act as a support or pedestal for the modular wall system.

Figure 5:
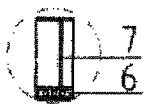
FIG. 5 is a cross-sectional side view of the exemplary modular wall system of FIG. 2 and illustrates another potential embodiment for mounting a cover plate within a cavity, wherein the arrangement in this figure may provide a more functional and/or aesthetic way of arranging the system.
Figure 6:
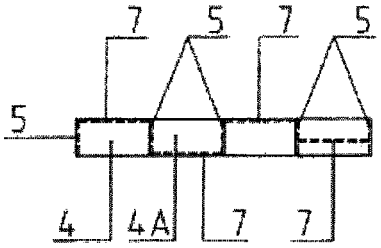
FIG. 6 is a top view of the exemplary modular wall system of FIG. 2, wherein dashed lines illustrate some of the potential arrangements of cavities and cover plates within the system.

FIGS. 5 and 6 show different views of the cavities 4, 4A where the cover plate 7 is installed in an alternative position near the middle or center of the cavity, thus forming a decorative wall as well as convenient cubby holes or shelves on both sides of the modular wall system. It should be appreciated that the modular wall system disclosed herein is not strictly limited to the alternating cavity arrangement shown in the drawings where every other cavity opens to an opposite side of the modular wall system. It is possible, for example, for the modular wall system to have a random distribution of cavities opening to a front side of the modular wall system, a back side, or both sides. Such an arrangement may present an aesthetically striking appearance where cavities or cubby holes are randomly distributed between the front, back, or both sides of the modular wall system.

Figure 7:
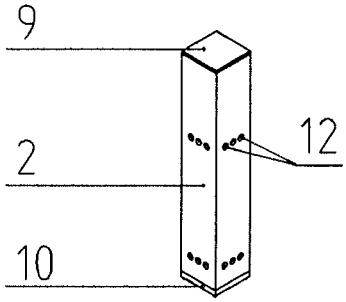
FIG. 7 is a perspective view of an exemplary column that may be used with the modular wall system shown in FIG. 1, although other column shapes may be used as well.
Figure 8:
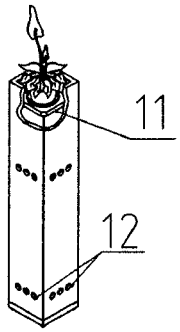
FIGS. 8 and 9 are perspective views of an exemplary column that may be used with the modular wall system shown in FIG. 1, wherein these columns include functional and aesthetic options such as a pot for a plant and a lamp or luminary support.
Figure 9:
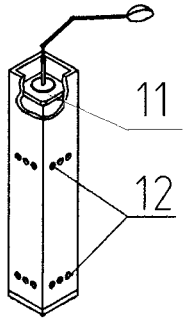

Columns 2 may be used to join or attach several modules 1 together to form a modular or panel wall, and may serve as structural elements for the modules 1. In some embodiments, one or more columns 2 connect one or more modules 1 together to form a layout for work areas or cubicles of various sizes and configurations. Such a layout may include one or more columns 2 and modules 1 in a corner or right-angle configuration; in other embodiments, a column 2 may attach two or more modules 1 together along a straightaway section such that they form a long modular wall system. Both of these examples are illustrated in the perspective view of FIG. 1. Furthermore, the columns 2 may have a variety of different cross sections, such as square, triangular, hexagonal cross sections, etc. Where the modular wall system is part of a working area layout, column 2 may include a column foot or pedestal 10 and/or a removable column cover 9. According to the exemplary embodiments shown in FIGS. 7-9, column 2 may be fitted with one of a number of different top pieces, including a column cover 9 that sits flush on top of the column or a column shelf 11 that is recessed somewhat within the column so that items such as a plant or lamp, etc. may sit on top of the column. The columns 2 may attach to the modules 1 using small nails, screws, brackets, or any other suitable attachment mechanism, or they may simply be situated adjacent one another without being securely attached.

Figure 3:
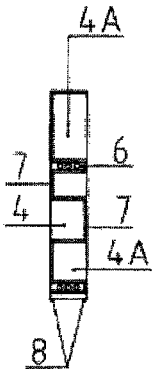
FIGS. 3 and 4 are cross-sectional side views of the exemplary modular wall system of FIG. 2 and illustrate several potential arrangements of the cavities and the internal rails.
Figure 4:
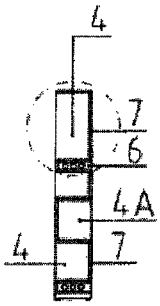

Being removable, column cover 9 provides wiring access to cables and utilities that pass through the internal rails 6 and other parts of the modular wall system, as well as other additional functions such as providing an ornamental receptacle. Columns 2 may be hollow and include one or more access holes 12 that communicate with the internal rails 6 in the modules such that cables or utilities can extend from one module to another. Examples of suitable passages and access holes are shown in the internal rails 6 in FIGS. 3-5, as well as the columns 2 shown in FIGS. 7-9. In one embodiment, the modules 1 and the columns 2 include internal rails that are connected and located for the passage of cables or utilities. Other access holes and openings may be provided instead, depending on the particular requirements of the application. Thus, the columns 2 interposed between the modules 1 may function as structural elements and also as cable or utilities pathways.

Figure 10:
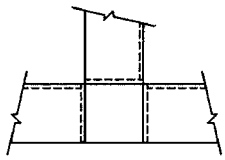
FIGS. 10, 11 and 12 are top views of several different exemplary columns that may be used with the modular wall system shown in FIG. 1, wherein the various columns have different potential geometric forms to suit different layout configurations.
Figure 11:
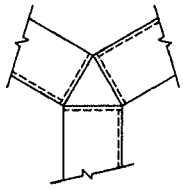
Figure 12:
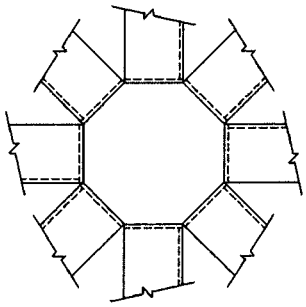

Finally, the different components of the modular wall system may vary in dimension, design, and finish according to the different operational and aesthetic requirements of the modular wall system. For example, FIG. 10 is a top view of an exemplary modular wall system configuration where three different modules 1 are joined together via a square-shaped column 2; FIG. 11 is a top view of an exemplary modular wall system configuration where three different modules 1 are joined together via a triangular-shaped column 2; and FIG. 12 is a top view of an exemplary modular wall system configuration where eight different modules 1 are joined together by a octagonal-shaped column 2. Each of the exemplary columns 2 described herein has a cross sectional format to better merge the different modules 1 and to result in a better structure and a more convenient layout. Again, these are only some of the potential shapes and configurations, as numerous others also exist.

It is to be understood that the foregoing description is not a definition of the invention, but is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A modular wall system, comprising:

a module having a horizontal dimension, a vertical dimension, and a thickness dimension;

one or more board plates being attached to the module and extending in the horizontal dimension of the module, the board plates are arranged as horizontal shelves within the module;

one or more lateral plates being attached to the module and extending in the vertical dimension of the module, the lateral plates are arranged as vertical dividers within the module;

one or more cover plates being attached to the module; and a column being attached to the module and having one or more access holes that allow for cables or utilities to extend from one module to another, wherein the board plates, the lateral plates, and the cover plates are arranged generally perpendicular to one another to define a plurality of open and uncovered cavities each of which is integrally formed within the thickness dimension of the module and is only open on one side of the module, and at least two of the plurality of open cavities are adjacent one another within the module and share a common board plate or a common lateral plate between them, and the at least two open cavities with shared board or lateral plate extend the entire thickness dimension of the module and are arranged to open on different front and rear sides of the module.

2. The modular wall system of claim 1, wherein the board plates, the lateral plates, and one or more cover plates form the plurality of open cavities that alternate between opening on a first side of the module and on a second opposite side of the module, and the plurality of open cavities serve as shelves.

3. The modular wall system of claim 2, wherein the one or more cover plates can be aesthetically or functionally positioned at a predetermined depth in the cavities.

4. The modular wall system of claim 1, wherein each of the module and the column has one or more internal rails that are connected and located for the passage of the cables or utilities.

5. The modular wall system of claim 1, further comprising a plurality of modules and a plurality of columns that together form a layout for work areas or cubicles.

6. The modular wall system of claim 5, wherein the plurality of columns interposed between the plurality of modules function as structural elements and also as cable or utilities pathways.

7. The modular wall system of claim 6, wherein each of the plurality of columns has a cross sectional format that enables merging the plurality of modules together.

8. The modular wall system of claim 6, wherein each of the plurality of columns has a removable column cover for providing wiring access and other additional functions, such as providing an ornamental receptacle.

9. A module for use in a modular wall system, comprising:

a plurality of flat horizontal members;

a plurality of flat vertical members being attached to the flat horizontal members such that the vertical and horizontal members form a criss-cross framework that includes a front side, a rear side, and a plurality of cubby-holes located therebetween in a thickness dimension, and at least two of the plurality of cubby-holes share a common horizontal member or a common vertical member between them, and the at least two cubby-holes with the shared horizontal or vertical member extend the entire thickness dimension of the module and are arranged to open on different sides of the module;

a plurality of cover plates being attached to the framework, and at least some of the flat horizontal members, the flat vertical members and the cover plates close off the at least two cubby-holes so that one of the at least two cubby-holes is open and uncovered only on the front side of the framework and the other of the at least two cubby-holes is open and uncovered only on the rear side of the framework; and an internal rail being attached to the framework and extending through the module such that the internal rail accommodates one or more utilities, wherein the module is both a partition and an integrated non-sliding shelving system.

10. The module of claim 9, wherein the plurality of cover plates includes a first cover plate attached to the front side of the framework such that a corresponding first cubby-hole opens to the rear side, and a second cover plate attached to the rear side of the framework such that a corresponding second cubby-hole opens to the front side.

11. The module of claim 10, wherein the first and second cubby holes are adjacent one another on the framework such that they alternate between opening on the front and rear sides.

12. The module of claim 9, wherein the plurality of cover plates includes a cover plate attached to the framework in between the front and rear sides such that a corresponding first cubby-hole opens to the rear side and a corresponding second cubby-hole opens to the front side.

13. The module of claim 9, wherein the plurality of cover plates includes a cover plate that is solid and non-transparent.

14. The module of claim 9, wherein the plurality of cover plates includes a cover plate that is transparent like a window.

15. The module of claim 9, wherein at least one of the flat horizontal members acts as a shelf in a cubby-hole.

16. The module of claim 9, wherein at least one of the flat vertical members has an access hole that lines up with the internal rail such that the utilities may extend out of the module.

17. The module of claim 9, wherein the module is attached to a column along one of the flat vertical members.

18. The module of claim 9, further comprising a column that includes an access hole that lines up with an access hole in the attached flat vertical member such that the utilities may extend between the module and the column.

19. The module of claim 9, further comprising a column that is hollow and includes a removable cover at an upper end that provides access to the inside of the hollow column.

20. The module of claim 9, further comprising a column that includes a recessed column shelf at an upper end that supports an object.

21. The module of claim 9, wherein the plurality of cover plates includes a cover plate attached to the framework in between the front and rear sides such that a corresponding first cubby-hole opens to one side and a corresponding second cubby-hole opens to another opposite side.

22. The module of claim 9, wherein the plurality of cover plates includes a cover plate attached to the framework which is installed in an alternative position in the middle or center of the cavity.

* * * * *